US005366343A

United States Patent [19]

Müller

[11] Patent Number: 5,366,343

[45] Date of Patent: Nov. 22, 1994

[54] SELF-ADJUSTING TORQUE-RESPONSIVE VARIABLE-PITCH BOAT PROPELLER

[75] Inventor: Peter Müller, Adliswil, Switzerland

[73] Assignee: Dr. Alexander Landolt, Zurich, Switzerland

[21] Appl. No.: 126,082

[22] Filed: Sep. 23, 1993

[30] Foreign Application Priority Data

Sep. 23, 1992 [DE] Germany ..... 4231814

[51] Int. Cl.[5] ..... B63H 3/00

[52] U.S. Cl. ..... 416/133; 416/137; 416/140; 416/45

[58] Field of Search ..... 416/133, 135, 136, 137, 416/140, 43, 45

[56] References Cited

U.S. PATENT DOCUMENTS

| | | | |
|---|---|---|---|
| 1,765,091 | 6/1930 | Morris | 416/137 |
| 1,864,045 | 6/1932 | Kellogg et al. | 416/133 |
| 1,980,248 | 11/1934 | Bates | 416/133 |
| 1,980,249 | 11/1934 | Bates | 416/133 |
| 2,075,682 | 3/1937 | Welman | 416/133 |
| 2,468,004 | 4/1949 | Walker | 416/133 |
| 3,362,479 | 1/1968 | Wilkinson . | |
| 3,403,735 | 10/1968 | Langhjelm . | |
| 3,915,590 | 10/1975 | Bjorknas . | |
| 4,140,434 | 2/1979 | Bianchi | 416/140 |
| 4,792,279 | 12/1988 | Bergeron . | |
| 4,897,056 | 1/1990 | Muller . | |

*Primary Examiner*—Edward K. Look
*Assistant Examiner*—James A. Larson
*Attorney, Agent, or Firm*—Herbert Dubno; Andrew Wilford

[57] ABSTRACT

A self-adjusting variable-pitch propeller has a drive shaft rotatable about a shaft axis in a predetermined forward rotational sense, a hub carried on the drive shaft and limitedly rotatable relative thereto about the shaft axis both in the forward rotational sense and in an opposite backward rotational sense, and a spring operatively braced between the hub and the shaft for rotationally urging the hub on the shaft in the forward rotational sense. A plurality of blades projecting radially from the hub are each rotatable about a respective blade axis generally perpendicular to the shaft axis. Respective rods extending axially in the hub each have an inner end at a respective one of the blades and an outer end. Respective linkages connecting the inner ends of the rods to the respective blades angular displace the blades about the respective axes on relative displacement of the rods and hub. A coupling engaged between the shaft and the hub and to the outer ends of the rods displaces the rods relative to the hub axially or angularly to an extent corresponding to the relative rotation in the backward rotational sense against a force exerted on the hub by the spring.

14 Claims, 3 Drawing Sheets

SELF-ADJUSTING TORQUE-RESPONSIVE VARIABLE-PITCH BOAT PROPELLER

SPECIFICATION

1. Field of the Invention

The present invention relates to a variable-pitch propeller. More particularly this invention concerns a self-adjusting variable-pitch propeller as used on a recreational watercraft.

2. Background of the Invention

A standard variable-pitch propeller has a hub carried on a drive shaft and rotatable thereby. Several vanes or blades project radially from the hub and are each pivotal about a respective axis extending radially of the shaft. Each blade in turn is associated via a linkage with a respective axially extending rod that reaches to one end of the hub. The rods and hub are relatively axially displaced to pivot the respective blade.

As seen in my earlier U.S. Pat. No. 4,897,056 issued 30 Jan. 1990, a hand-operated wheel is provided at the one end of the hub to allow for adjustment of the pitch of the blades. Thus when the boat is stopped, the operator reaches over the side and turns the wheel to set the desired pitch angle. Precise adjustments are possible, but only with the boat stopped.

In order to provide automatic adjustment, as for instance when pulling a water skier where maximum speed must be reached as soon as possible, it is known to provide self-adjusting variable-pitch propellers. Accordingly U.S. Pat. No. 4,792,279 issued 20 Dec. 1988 proposes a system which responds to centrifugal force to set the blade angle automatically. Similarly in U.S. Pat. No. 3,403,735 issued 1 Oct. 1968 the loading of the blades determines their pitch. Such systems offer only a fairly crude adjustment since centrifugal force is purely a function of rotational speed and loading can vary widely depending on angle, immersion circumstances, and the like.

OBJECTS OF THE INVENTION

It is therefore an object of the present invention to provide an improved self-adjusting variable-pitch propeller.

Another object is the provision of such an improved self-adjusting variable-pitch propeller which overcomes the above-given disadvantages, that is which automatically sets the blades at a pitch precisely determined for maximum efficiency under the current operating conditions.

SUMMARY OF THE INVENTION

A self-adjusting variable-pitch propeller has according to the invention a drive shaft rotatable about a shaft axis in a predetermined forward rotational sense, a hub carried on the drive shaft and limitedly rotatable relative thereto about the shaft axis both in the forward rotational sense and in an opposite backward rotational sense, and a spring operatively braced between the hub and the shaft for rotationally urging the hub on the shaft in the forward rotational sense. A plurality of blades projecting radially from the hub are each rotatable about a respective blade axis generally perpendicular to the shaft axis. Respective rods extending axially in the hub each have an inner end at a respective one of the blades and an outer end. Respective linkages connecting the inner ends of the rods to the respective blades angularly displace the blades about the respective axes on relative displacement of the rods and hub. A coupling engaged between the shaft and the hub and to the outer ends of the rods displaces the rods relative to the hub angularly or axially to an extent corresponding to the relative rotation in the backward rotational sense against a force exerted on the hub by the spring.

Thus this system is responsive to the torque exerted on the propeller blades and hub. This torque is the ideal characteristic to respond to, as it allows the drive engine for the propeller to run at its most efficient speed, while the propeller is set at the angle to move the watercraft at maximum speed also. In other words, while the engine is running at a constant load, which is always ideal, the propeller is adjusting itself to transmit all the work to the water. Similarly if the motor speed is changed, the propeller will again automatically adjust to compensate and operate at its most efficient blade angle.

According to a feature of this invention the rods are rotatable about respective rod axes to angularly adjust the respective blades. The propeller further has according to the invention a center gear fixed on the shaft at the outer ends of the rods and respective pinions meshing with the center gear and fixed on the outer ends of the rod so that, when the shaft rotates relative to the hub in which the rods are seated, the pinions are rotated. Each such linkage in this case comprises a respective worm gear on the inner end of each rod and a respective worm wheel on each blade meshing with the respective worm gear.

The spring according to this invention is a multiple-turn torque spring braced between the shaft and the hub. Furthermore the hub is axially movable on the shaft and the coupling means axially displaces the hub on the shaft on relative rotation between the hub and the shaft. The shaft has a rear end axially but not rotationally coupled to the outer ends of the rods. The coupling means is formed by interengaging screwthread formations on the shaft and hub and the spring is also braced axially between the hub and the shaft.

To prevent the propeller from spinning out, a damper is provided for inhibiting relative rotation between the hub and the shaft. Such a damper can include a pair of separate substantially closed and liquid-filled chambers formed between the shaft and the hub such that as the shaft and hub rotate in the forward sense one of the chambers increases in volume and the other decreases in volume and vice versa, a liquid-filled conduit interconnecting the two chambers, and a variable or adjustable restriction. The damper can also include a valve responsive to rotational speed of the propeller for closing the conduit when the rotational speed of the propeller lies below a predetermined threshold. This prevents unnecessary automatic adjustments at low speed. The valve can include a valve seat in the conduit, a valve body movable radially outwardly of the axis away from the seat to free same and permit flow through the conduit and movable radially inward onto the seat to block flow through the conduit, and a spring urging the valve body radially inward. According to a further feature of this invention a check valve is connected between the chambers for free liquid flow therebetween in only one direction, that is to allow the propeller to return to its maximum pitch or starting position. Thus if the engine suddenly slows down, the propeller will return immediately to its steep-pitch position that is more efficient at low torque.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
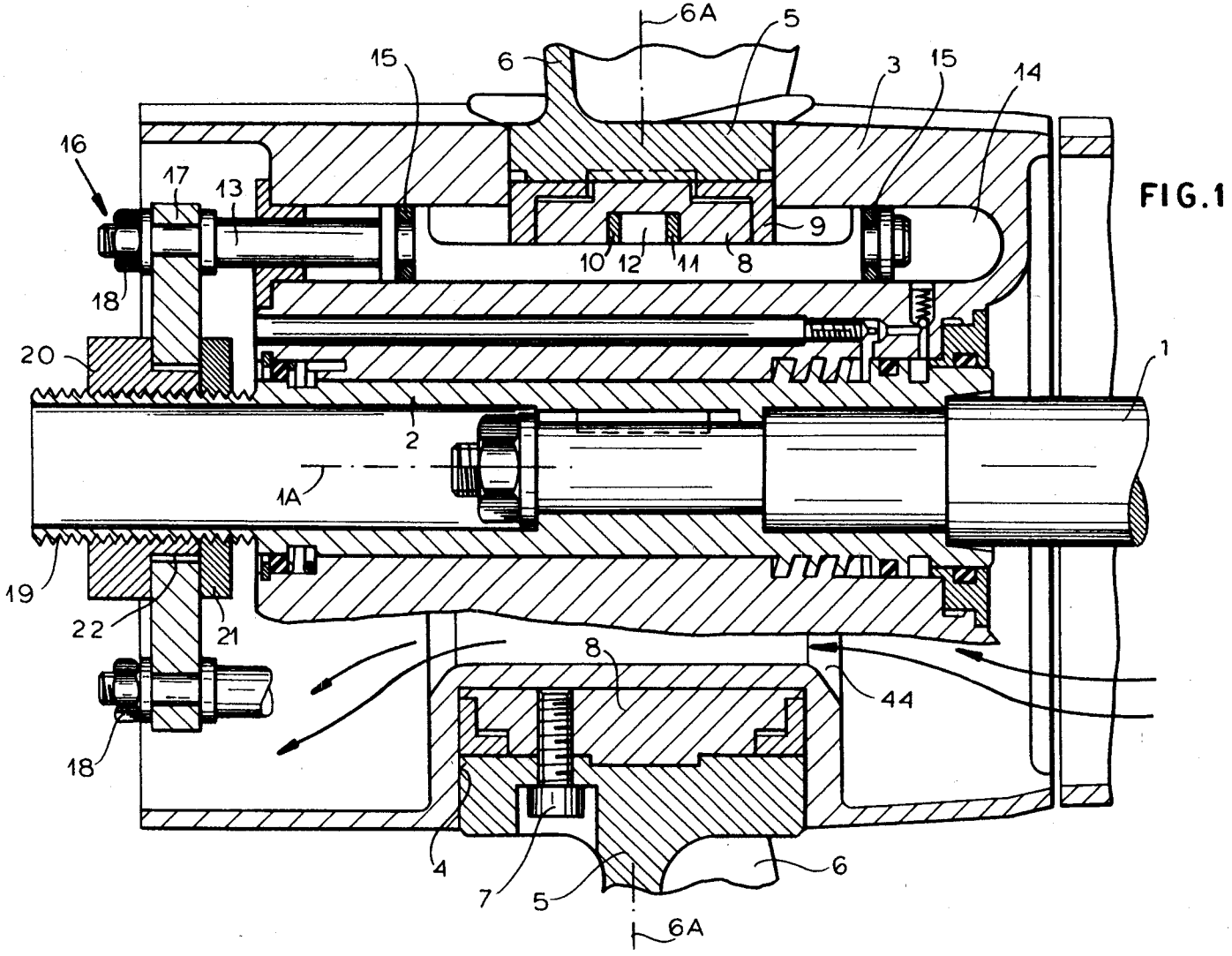
FIG. 1 is a partly diagrammatic axial section through the propeller assembly of this invention.

As seen in FIG. 1 an engine output shaft 1 normally rotated in a forward rotational sense about its axis 1A by an unillustrated engine has a tube-shaft part 2 also centered on the axis 1A and fixed to the primary shaft 1. A hub 3 is carried on the shaft 1, 2 and can rotate thereon limitedly about the axis 1A between unillustrated angular stops and can also move limitedly axially on the shaft 1, 2. Passages 44 for throughflow of exhaust gases are formed in the hub 3.

The hub 3 is formed with a plurality of angularly equi-spaced and radially outwardly open sockets 4 in each of which a base 5 of a respective blade 6 can pivot about a respective axis 6A perpendicular to the axis 1A. The blade bases 5 are each secured by bolts 7 to a base 8 in which is formed an eccentric socket groove 10 in which is seated a respective pin 12 carrying a respective bearing 11. The bases 8 are screwed to journal rings 9 to facilitate turning of the blades 6. For the blades 6 to pivot about their axes 6A, the hub 3 must therefore move axially relative to the shaft 1, 2.

Respective pitch-setting rods 13 are axially slidable in respective axially rearwardly open bores 14 formed in the hub 3 and each such rod 13 carries a respective one of the pins 12. Seals 15 are provided to protect the linkages formed by the pins 12 and bases 8 by preventing water from freely entering into this critical region.

The rods 13 have rear ends 16 secured by nuts 18 in an annular adjustment plate 17 whose inner periphery is seated in a groove 22 formed between a pair of nuts 20 and 21 threaded on a screwthread 19 at the rear end of the tube shaft 2. The plate 17 can rotate relative to the shaft 1, 2 but is axially coupled thereto. Thus if the hub 3 moves axially relative to the shaft 1, 2 the angular position of the blades 6 relative to their axes 6A will be changed.

Figure 2:
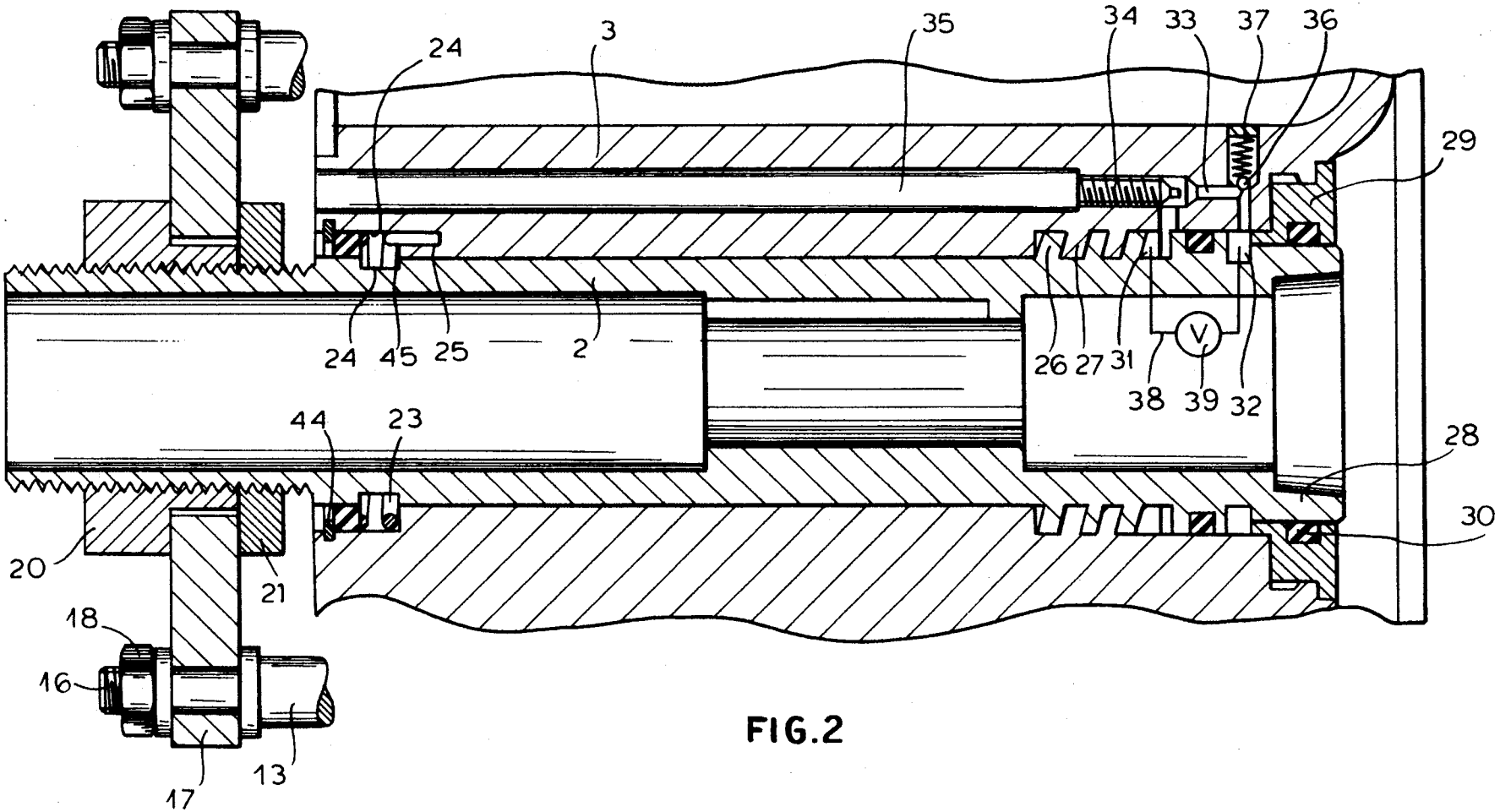
FIG. 2 is a larger-scale view of a detail of FIG. 1.

As seen in FIG. 2 a coil spring 23 received in an annular pocket 24 formed between the shaft 2 and hub 3 is located between a snap ring 44 set in the hub 3 and a shoulder 45 of the shaft 2, and has an end seated at 25 in the hub 3 and an opposite end seated in a similar but unillustrated hole in the shaft 2. Thus this spring 23 serves to urge the hub 3 axially backward on the shaft 2 while at the same time urging the two parts 2 and 3 rotationally relative to each other in the forward position to an end position against one of the unillustrated angular stops.

The shaft 2 is formed with a coarse screwthread 26 meshing with a complementary screwthread 27 of the hub 3. The hand of this screwthread connection 26, 27 is such that the spring 23 rotationally biases the shaft 2 relative to the hub 3 so that it screws the hub 3 axially backward, which is in fact the same forward rotation direction that the shaft 1, 2 is normally rotated in by the watercraft's engine. Thus when the shaft 1, 2 is at rest or is rotating and the force urging the hub 3 in the opposite backward rotational sense is less than the force of the spring 23, the hub 3 will be all the way back on the shaft 1, 2 and the blades 6 will be set at their maximum-pitch angle, that is forming a relatively large angle with a plane perpendicular to the shaft axis 1A. This is therefore the pitch at start-up or when operating under such conditions that the water offers low resistance to rotation of the blades 6.

When, however, the blades 6 meet substantial resistance so that the hub 3 is torqued backward against the normal forward shaft rotation direction on the shaft 1, 2, the hub 3 is screwed forward and the pitch angle of the blades 6 is leathered by making the angle each blade 6 forms relative to the above-cited plane smaller. Hence if the blades 6 are meeting considerable resistance, their attack angle is feathered to make them work more efficiently. Normally this means that at low speed the blade pitch will be great but at high speeds it will be small. This arrangement ensures that the engine driving the shaft core 1 will be able to work in its range of optimum efficiency.

The forward end of the outer shaft part 2 is of reduced diameter as shown in FIG. 2 and the hub is provided with a brake ring 29 having a friction ring 30 that bears radially inward on this reduced-diameter shaft end. This ring 30 exerts some friction on the shaft 1, 2 relative to the hub 3 to prevent it from moving too freely, that is to inhibit relative rotation unless a certain minimal force is exerted.

As further shown in FIG. 2, the hub 3 and shaft 1, 2 together form a pair of small annular liquid-filled chambers 31 and 32 interconnected by a small passage 33 formed in the hub 3. The structure of the hub 3 and shaft 1, 2 forming these chambers 31 and 32 is such that as the hub 3 moves back on the shaft 2 the chamber 31 will increase in volume and the chamber 32 will complementarily decrease in volume, and vice versa.

The conduit or passage 33 is provided with a restriction or flow-limiting valve 34 which can be accessed through a rearwardly open hole in the hub 3 to adjust flow through the passage 33. In addition a valve ball 36 urged radially inward in the passage 33 normally blocks flow therethrough unless the valve is thrown centrifugally outward with a force exceeding the force with which a spring 37 urges it radially inward. Thus not only is absolute flow through the passage limited by the valve 34, but below a certain rotation speed of the propeller there is no flow possible so that the blades will remain at their maximum pitch angle.

FIG. 2 also shows how another conduit 38 can interconnect the chambers 31 and 32 and be provided with a check valve 39 that permits flow only from the compartment 31 to the compartment 32. Thus if the torque applied by the water against the blades 6 suddenly drops, as for instance if the prop moves partly out of the water, the pitch angle will be able to increase rapidly, without respect to the damping action of the valve 34.

Figure 3:
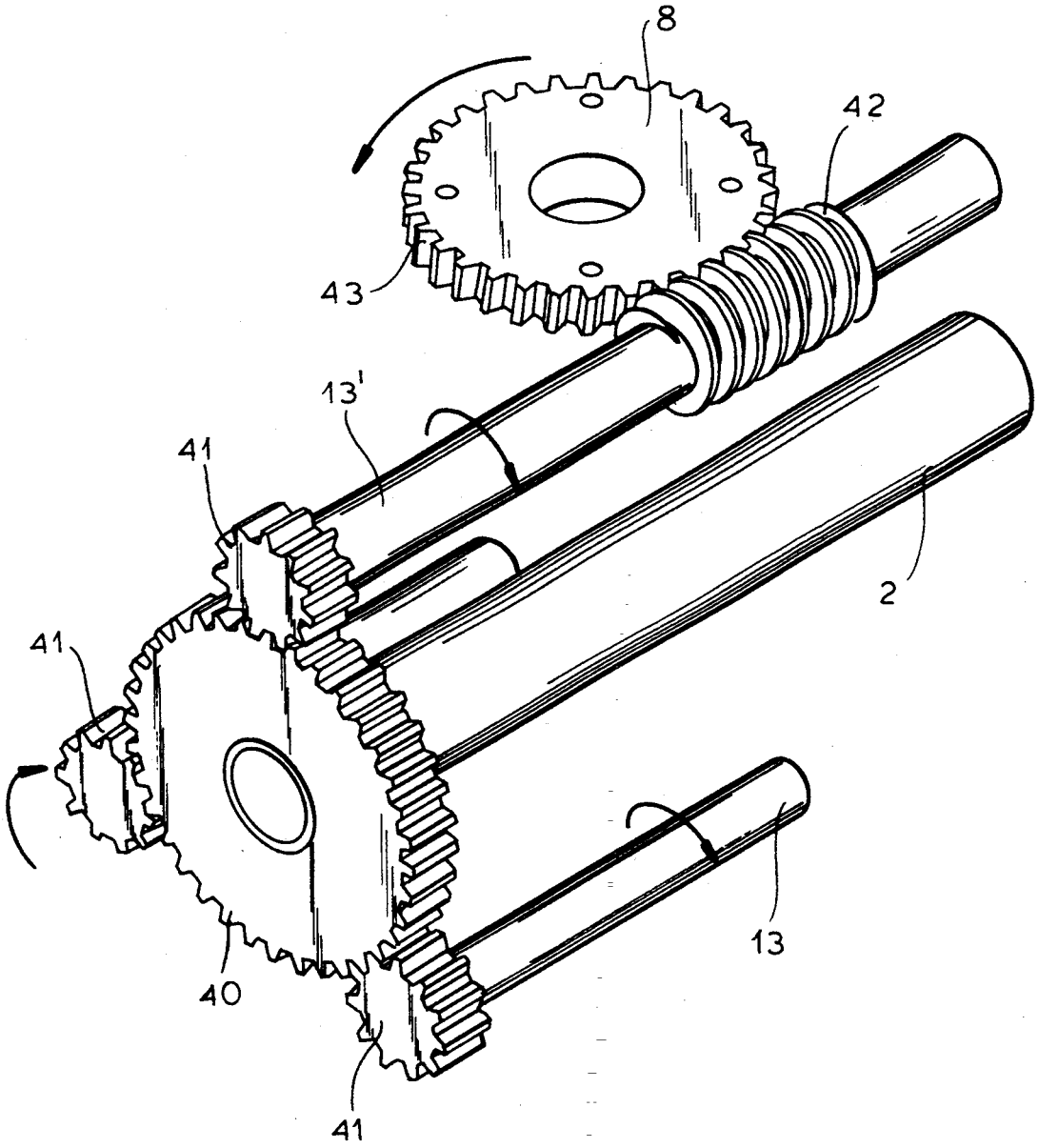
FIG. 3 is a perspective detail view of an alternative arrangement according to the invention.

FIG. 3 shows an alternate arrangement where the rear end of the shaft 2 carries coupling means constituted in part by a central gear 40 meshing with three pinions 41 each carried on a respective adjustment rod 13'. The blades are here mounted on bases 8 carrying gears 43 meshing with respective worms 42 on the rods 13'. Thus as the shaft 2 rotates relative to the hub relative to which the shafts 13' are fixed axially, these shafts 13' will be rotated about their own axes and will angularly move the gears 43 and the blades carried thereby.

I claim:

1. A self-adjusting variable-pitch propeller comprising:

a drive shaft rotatable about a shaft axis in a predetermined forward rotational sense;

a hub carried on the drive shaft, axially displaceable thereon, and limitedly rotatable relative thereto about the shaft axis both in the forward rotational sense and in an opposite backward rotational sense;

spring means operatively braced between the hub and the shaft for rotationally urging the hub on the shaft in the forward rotational sense;

a plurality of blades projecting radially from the hub and each rotatable about a respective blade axis generally perpendicular to the shaft axis;

respective rods extending axially in the hub parallel to the shaft axis, fixed axially to the shaft, and each having an inner end at a respective one of the blades and an outer end;

respective linkages connecting the inner ends of the rods to the respective blades for angular displacement of the blades about the respective blade axes on displacement of the hub axially of the shaft axis relative to the shaft and rods;

coupling means operatively engaged between the shaft and the hub for displacing the hub relative to the shaft and rods to an extent corresponding to the relative rotation in the backward rotational sense against a force exerted on the hub by the spring means; and hydraulic damping means for inhibiting relative rotation between the hub and the shaft below a predetermined torque applied to the hub by the blades.

2. The self-adjusting variable-pitch propeller defined in claim 1 wherein the spring means includes a torque spring braced between the shaft and the hub.

3. The self-adjusting variable-pitch propeller defined in claim 1 wherein the hub is axially movable on the shaft, the coupling means axially displacing the hub on the shaft on relative rotation between the hub and the shaft, the shaft having a rear end axially but not rotationally coupled to the outer ends of the rods.

4. The self-adjusting variable-pitch propeller defined in claim 3 wherein the coupling means is formed by interengaging screwthread formations on the shaft and hub.

5. The self-adjusting variable-pitch propeller defined in claim 3 wherein the spring means includes a spring braced between the hub and the shaft.

6. The self-adjusting variable-pitch propeller defined in claim 1 wherein the damping means includes a pair of separate substantially closed and liquid-filled chambers formed between the shaft and the hub such that as the shaft and hub rotate in the forward sense one of the chambers increases in volume and the other decreases in volume and vice versa, a liquid-filled conduit interconnecting the two chambers, and a restriction in the conduit.

7. The self-adjusting variable-pitch propeller defined in claim 6 wherein the restriction is adjustable.

8. The self-adjusting variable-pitch propeller defined in claim 6 wherein the damping means further includes valve means responsive to rotational speed of the propeller for closing the conduit when the rotational speed of the propeller lies below a predetermined threshold.

9. The self-adjusting variable-pitch propeller defined in claim 8 wherein the valve means includes a valve seat in the conduit, a valve body movable radially outwardly of the shaft axis away from the seat to free the seat and permit flow through the conduit and movable radially inward onto the seat to block flow through the conduit, and spring means urging the valve body radially inward.

10. The self-adjusting variable-pitch propeller defined in claim 6, further comprising a check valve connected between the chambers for free liquid flow therebetween in only one direction.

11. The self-adjusting variable-pitch propeller defined in claim 10 wherein the check valve only permits such free flow on rotation of the hub in the forward direction relative to the shaft.

12. A self-adjusting variable-pitch propeller comprising:

a drive shaft rotatable about a shaft axis in a predetermined forward rotational sense;

a hub carried on the drive shaft, axially displaceable thereon, and limitedly rotatable relative thereto about the shaft axis both in the forward rotational sense and in an opposite backward rotational sense;

spring means operatively braced between the hub and the shaft for rotationally urging the hub on the shaft in the forward rotational sense;

a plurality of blades projecting radially from the hub and each rotatable about a respective blade axis generally perpendicular to the shaft axis;

respective rods extending axially in the hub parallel to the shaft axis, fixed axially to the shaft, and each having an inner end at a respective one of the blades and an outer end;

respective linkages connecting the inner ends of the rods to the respective blades for angular displacement of the blades about the respective blade axes on displacement of the hub axially of the shaft axis relative to the shaft and rods;

coupling means operatively engaged between the shaft and the hub for displacing the hub relative to the shaft and rods to an extent corresponding to the relative rotation in the backward rotational sense against a force exerted on the hub by the spring means; and damping means including a friction brake engaged between the shaft and hub for inhibiting relative rotation between the hub and the shaft below a predetermined torque applied to the hub by the blades.

13. The self-adjusting variable-pitch propeller defined in claim 12 wherein each linkage comprises:

a respective worm gear on the inner end of each rod, and a respective worm wheel on each blade meshing with the respective worm gear.

14. A self-adjusting variable-pitch propeller comprising:

a drive shaft rotatable about a shaft axis in a predetermined forward rotational sense;

a hub carried on the drive shaft and limitedly rotatable relative thereto about the shaft axis both in the forward rotational sense and in an opposite backward rotational sense;

spring means operatively braced between the hub and the shaft for rotationally urging the hub on the shaft in the forward rotational sense;

a plurality of blades projecting radially from the hub and each rotatable about a respective blade axis generally perpendicular to the shaft axis;

respective displaceable rods extending in the hub along respective rod axes parallel to the shaft axis and each having an inner end at a respective one of the blades and an outer end;

respective linkages connecting the inner ends of the rods to the respective blades for angular displacement of the blades about the respective blade axes on angular displacement of the rods about the respective rod axes; and coupling means connected to the outer ends of the rods and including a center gear fixed at the outer ends of the rods on the shaft; and respective pinions meshing with the center gear and fixed on the outer ends of the rods for rotating the rods to an angular extent corresponding to the relative rotation in the backward rotational sense against a force exerted on the hub by the spring means, whereby, when the shaft rotates relative to the hub in which the rods are seated, the pinions are rotated.

* * * * *